US008613830B2

(12) United States Patent
Seppälä et al.

(10) Patent No.: US 8,613,830 B2
(45) Date of Patent: Dec. 24, 2013

(54) METHOD OF MODIFYING THE PRINTING SURFACE OF PAPER OR BOARD

(75) Inventors: Jukka Seppälä, Helsinki (FI); Arto Salminen, Espoo (FI)

(73) Assignee: Helsinki University of Technology, TKK (FI)

( * ) Notice: Subject to any disclaimer, the term of this patent is extended or adjusted under 35 U.S.C. 154(b) by 531 days.

(21) Appl. No.: 12/085,665

(22) PCT Filed: Dec. 1, 2006

(86) PCT No.: PCT/FI2006/000400

§ 371 (c)(1),
(2), (4) Date: Aug. 28, 2008

(87) PCT Pub. No.: WO2007/063172

PCT Pub. Date: Jun. 7, 2007

(65) Prior Publication Data

US 2009/0255641 A1 Oct. 15, 2009

(30) Foreign Application Priority Data

Dec. 1, 2005 (FI) ..... 20051234

(51) Int. Cl.
*D21H 17/43* (2006.01)

(52) U.S. Cl.
USPC ..... 162/164.1; 162/135; 162/179; 427/391; 427/395; 428/32.21

(58) Field of Classification Search
USPC ..... 162/135, 164.1, 164.6, 164.7, 162/168.1–168.3, 168.7, 175–178, 179; 347/105, 107; 427/389.9, 391, 394, 427/395; 428/32.11, 32.21, 32.28, 32.34; 525/54.3, 408, 437, 438
See application file for complete search history.

(56) References Cited

U.S. PATENT DOCUMENTS 4,877,680 A 10/1989 Sakaki et al.
6,517,678 B1 * 2/2003 Shannon et al. ..... 162/177

(Continued)

FOREIGN PATENT DOCUMENTS

EP 0 693 385 A1 1/1996
JP 62-6995 * 1/1987

(Continued)

OTHER PUBLICATIONS

Vlcek et al., "Anionic polymerization of acrylates. XIV. Synthesis of MMA/acrylate block copolymers initiated with ester-enolate/*tert*-alkoxide complex," Polymer, vol. 46, 2005, pp. 4991-5000.

(Continued)

*Primary Examiner* — Eric Hug
(74) *Attorney, Agent, or Firm* — Birch, Stewart, Kolasch & Birch, LLP

(57) ABSTRACT

A method of modifying the surface of a substrate which comprises a fibrous material. According to the present invention, the surface is brought into contact with a type of amphiphilic block copolymer which comprises one or several hydrophilic polymeric blocks and one or several hydrophobic polymeric blocks. Approximately 0.01-3 g/m$^2$ of the amphiphilic block copolymer are applied onto the surface. With the help of the present invention, it is possible to effectively modify the surface of paper in such a manner that it produces a good surface for printing, for instance for ink-jet printing.

Figure 1:
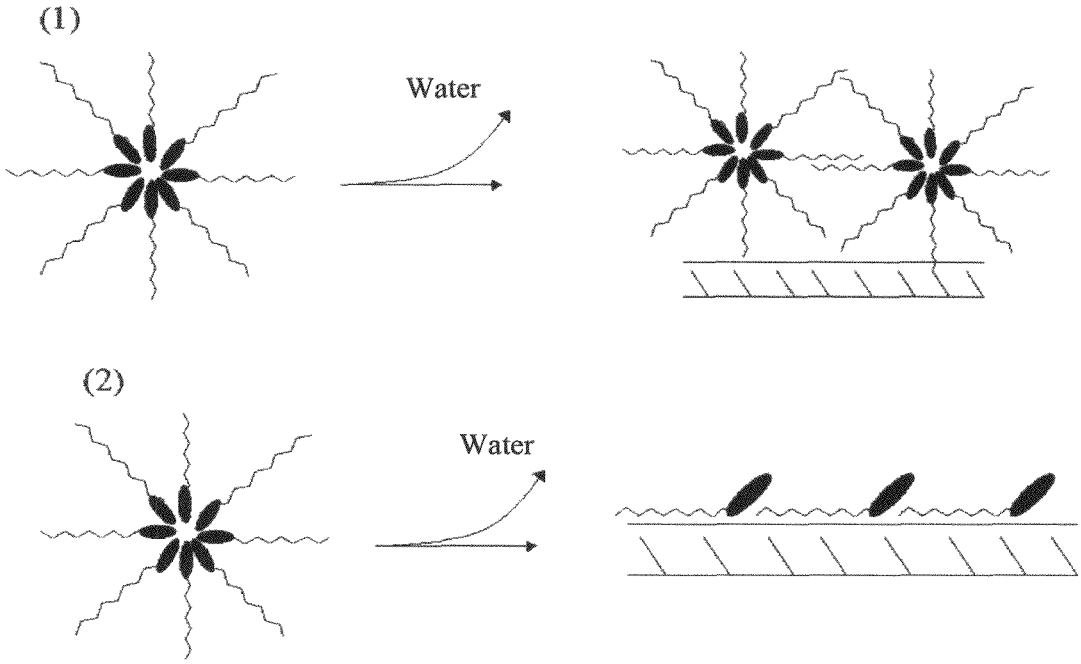

14 Claims, 5 Drawing Sheets
(2 of 5 Drawing Sheet(s) Filed in Color)

The effect of PEO-b-OSA block copolymers on the surface energy, fine paper base

(56) References Cited

U.S. PATENT DOCUMENTS

| | | | | |
|---|---|---|---|---|
| 6,534,157 | B1 | 3/2003 | Baker et al. | |
| 6,596,126 | B1 * | 7/2003 | Shannon et al. | 162/177 |
| 6,743,855 | B1 | 6/2004 | Thetford et al. | |
| 6,749,721 | B2 * | 6/2004 | Shannon et al. | 162/164.4 |
| 6,896,769 | B2 * | 5/2005 | Shannon et al. | 162/164.1 |
| 2002/0069989 | A1 * | 6/2002 | Feret et al. | 162/168.1 |
| 2003/0048344 | A1 | 3/2003 | Koga et al. | |
| 2004/0030030 | A1 | 2/2004 | Castaing et al. | |

FOREIGN PATENT DOCUMENTS

| | | | |
|---|---|---|---|
| JP | 09-058107 | A | 3/1997 |
| JP | 11-042849 | A | 2/1999 |
| WO | WO-03/004767 | A1 | 1/2003 |
| WO | WO 2006/128796 | * | 12/2006 |

OTHER PUBLICATIONS

Dworak et al., "Polyglycidol-block-poly(ethylene oxide)-block-polyglycidol:synthesis and swelling properties," Reactive & Functional Polymers, vol. 42, 1999, pp. 31-36.

Kurian et al., "Synthesis and Characterization of Novel Amphiphilic Block Copolymers Di-, Tri-, Multi-, and Star Blocks of PEG and PIB," Journal of Polymer Science: Part A: Polymer Chemistry, vol. 38, 2000, pp. 3200-3209.

Sugiyama et al., "Anionic polymerization of 2-haloethyl methacrylates," Polymer, vol. 44, 2003, pp. 4157-4164.

Chognot et al., "Physicochemical evaluation of PLA nanoparticles stabilized by water-soluble MPEO-PLA block copolymers," Journal of Colloid and Interface Science, vol. 268, 2003, pp. 441-447.

* cited by examiner

The effect of PEO-b-OSA block copolymers on the surface energy, fine paper base

METHOD OF MODIFYING THE PRINTING SURFACE OF PAPER OR BOARD

The present invention relates to a method of modifying the printability properties of a surface of a substrate which comprises fibre-rich material, especially the printing surface of paper or cardboard.

The present invention also relates to paper or cardboard web or sheet, and an amphiphilic block copolymer which comprises polyethylene oxide blocks in the form of water-soluble blocks and octadecenyl succinic acid units in the form of water-insoluble blocks.

When production of high-quality printing and high-quality printed materials is desired, special attention must be paid to the quality of the printing surface of the paper. Traditionally, printing methods have required a printing surface of high-quality and a comprehensive control of the printing process. Ongoing developments in printing materials together with new printing technologies, including ink-jet printing, result in increasingly different quality demands on printing materials.

Central measures of the quality of the surface to be printed are the penetration of the printing ink into the paper both transversally and perpendicularly, and the adhesion of the printing ink to the paper surface. Because of the physically and chemically heterogeneous nature of the paper, the base paper must be prepared in different ways to ensure the quality of the surface to be printed matches the requirements of the end application.

It is possible to prepare the surface to be printed either using physical or chemical methods. The purpose of both methods is to adjust in a controlled manner the capillary penetration and the absorption of the water and the organic dissolvents into the fibres of the paper and into the pores between the fibres, and to improve the adhesion of the printing ink to the paper. One of the most important physical working techniques is calendering the paper, in which method heat and pressure are used to compress the fibres into a more compact network.

Chemical improvement of the surface to be printed has traditionally been carried out using a polymer-bearing pigment coating, the thickness of which is typically 1-5 μm.

The surface of the paper is sealed by a process which employs a pigment coating, in which case the pigments cover the holes and pores of the sparse fibre network. In the known methods, the polymer acts as a binder and its most important task is to bind the pigment particles together and to bind the coating layer to the base paper.

The polymer which is used as a binder can be in water in the form of a solution, or an emulsion or a dispersion. The composition of the polymers can be either homopolymers or random copolymers. Generally, for instance polyvinyl alcohol, carboxy-methyl cellulose and starch derivatives are used as water-soluble polymers. Synthetic latexes represent polymers in dispersion form. Examples of these are styrene-butadiene-, acrylate- and vinyl acetate-based latexes.

Generally, the application onto the surface is carried out using a roller, but in recent years, new coating methods have been developed, such as curtain coating and spray coating, which require the polymers used as coatings to possess new properties.

Associated with the present invention, we have unexpectedly discovered that it is possible to affect the quality of the surface to be printed in a completely new way, namely by using nanotechnology. Especially, in the present invention, the surface of fibre substrates, such as paper and cardboard, is modified by bringing it into contact with an amphiphilic polymer.

Amphiphilic polymers are block copolymers, which comprise a hydrophilic and, correspondingly, a hydrophobic block. Due to the unique structure of the different blocks of the amphiphilic polymers, the interactions between the blocks and non-polar and polar dissolvents are very different. To avoid unfavourable interactions, the molecules often form self-organising structures in solutions. In fact, amphiphiles have long been employed as industrial surfactants.

In one important application the amphiphiles are used as emulsifiers and as stabilising agents in emulsions. The hydrophobic end of an amphiphile, which is used as an emulsifier, is dissolved into a hydrophobic compound and the hydrophilic end is in the aqueous phase. Block copolymers are used in the field of pharmacy, too. Self-organising structures can include hydrophobic pharmaceutical products and in this way increase the solubility of these pharmaceutical products in water. Because it is possible for micelles, in aqueous solutions, to dissolve hydrophobic compounds into themselves, amphiphiles are also used for extracting organic molecules from the aqueous phase. In this way, it is possible to avoid the use of organic dissolvents.

In the present invention, the field of application of the amphiphilic polymers is widened in the direction of polymers which are used in the coating of paper. Thus, the present invention generates amphiphilic block copolymers which are in water, and which are water-soluble, colloidal or in a micellar form, and which, through their self-organising property, can affect the quality of the printing surface. The polymer is spread onto the surface of the paper in the form of a highly diluted aqueous solution, whereby it is possible to apply the polymer evenly and at a low percentage as the water is removed in the drying stage.

FIG. 1 shows the principle of how the amphiphilic polymers can settle onto the surface of the paper. The result is a completely novel paper or cardboard product, the properties of which are mainly hydrophobic, due to the effect of the hydrophobic blocks that are not attached to the surface of the substrate.

According to a more preferable solution, an amphiphilic polymer is used, which comprises polyethylene oxide blocks as the water-soluble blocks, and octadecenyl succinic acid blocks as the water-insoluble blocks.

More specifically, the method according to the present invention is mainly characterized by contacting the surface with an amphiphilic block copolymer which comprises one or several hydrophilic polymer blocks and one or several hydrophobic polymer blocks.

The paper or the cardboard web or sheet, according to the present invention is, in turn, characterized by being produced by using a method as disclosed herein, and the amphiphilic block copolymer comprises polyethylene oxide blocks in the form of water-soluble blocks and octadecenyl succinic acid units in the form of water-insoluble blocks.

Considerable advantages can be achieved with the present invention. Thus, by using the nanotechnological approach, it is possible, using the amphiphilic polymers, to affect the quality of the printing surface even at very low percentages. Due to the amphiphilic character of the block copolymers, they are able to orientate on the surface of the paper and in this way the hydrophobic blocks of the polymers are able to orientate outwards from the surface and limit the penetration of both the aqueous and the dissolvent based printing inks. At the same time, the water-soluble block of the polymer anchors the polymer onto the surface of the fibre. Thus, the amphiphilic polymer forms a self-organised nanocoating on the surface of the structural parts of the fibre material, such as preferably on the surface of the fibres or the fillers.

By means of the present invention, it is possible to reduce the blotting paper effect of the paper or cardboard base and to control the capillary absorption of the printing ink. However, at the same time the surface of the paper is capable of fixing printing ink in such a way that a desired imprint, formed of the printing ink, is generated on the surface.

Besides the hydrophobing effect, we have unexpectedly discovered a mechanism which can be used to affect the quality of the printing surface by using amphiphilic polymers as so called thermobonding agents, which, due to the effect of the calendering, bind the fibre structure together thereby forming a denser network, and in this way affect the penetration of the printing inks.

Furthermore, we have unexpectedly discovered that by using the approach which we have chosen it is possible to modify the quality of the printing surface of the paper or cardboard (hereinafter, often shortened to just "paper"). With the amphiphilic polymers according to the present invention, it is possible to delay the penetration of in particular water-soluble inks into the structure of the paper and to change the surface energy of the paper along with the contact angles into a direction which benefits the surface to be printed.

The polymers which have a composition according to the present invention can be used in very small quantities per area unit. The surface properties of for instance paper or cardboard that is used for different printing applications can be modified with the help of the polymer material. According to one preferred embodiment, the treatment is carried out using a ready-prepared web, i.e. a web which is generated in the drying section of a paper or cardboard machine.

In the following, the present invention will be examined more closely with the aid of a detailed description and the accompanying drawings.

The patent or application file contains at least one drawing executed in color. Copies of this patent or patent application publication with color drawing(s) will be provided by the office upon request and payment of the necessary fee.

Figure 2:
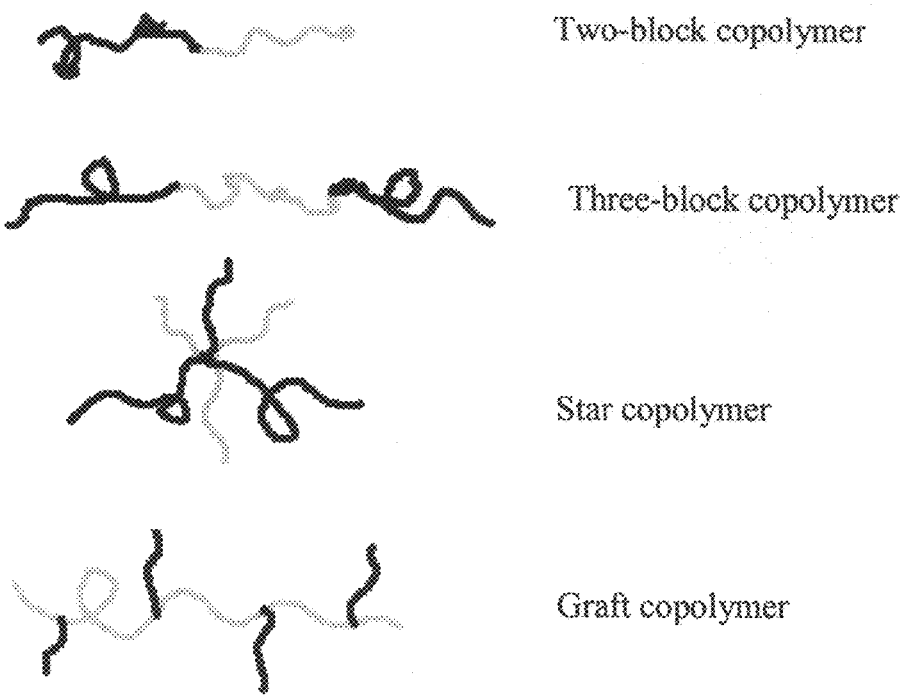
Figure 3:
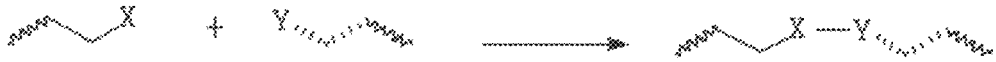
Figure 4A:
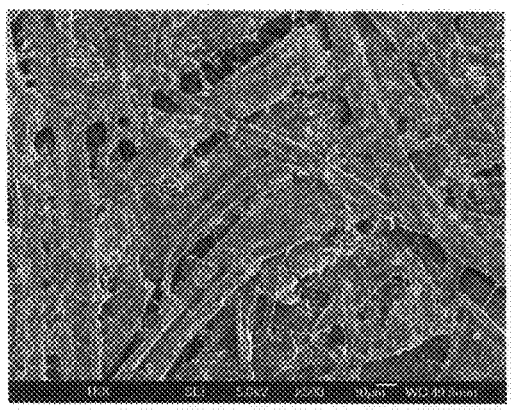
Figure 4B:
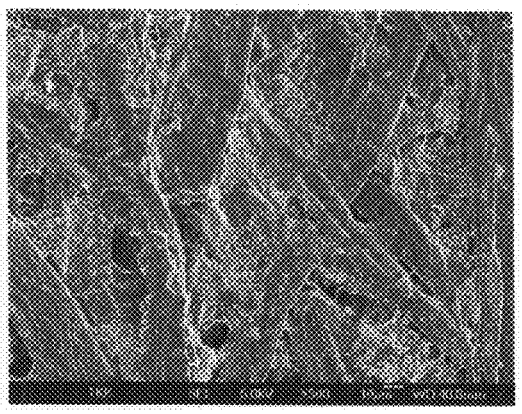
Figure 5A:
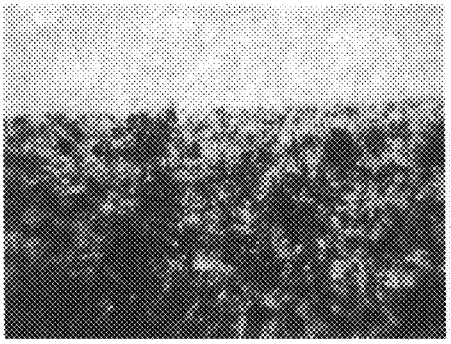
Figure 5B:
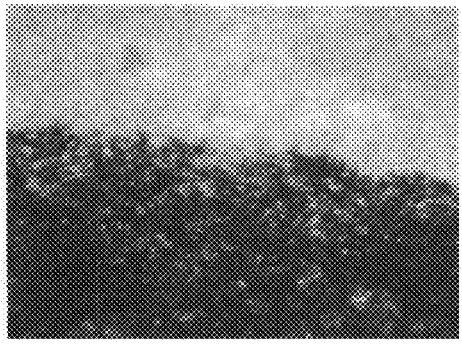
Figure 6:
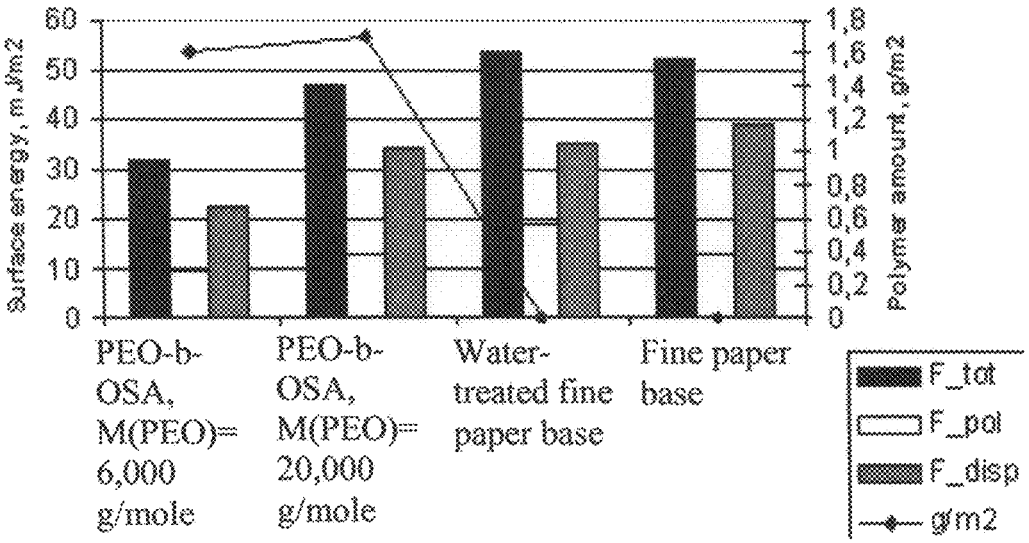
Figure 7A:
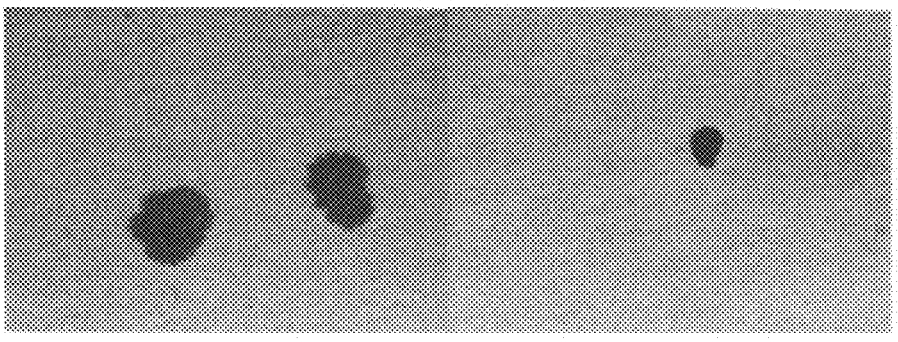
Figure 7B:
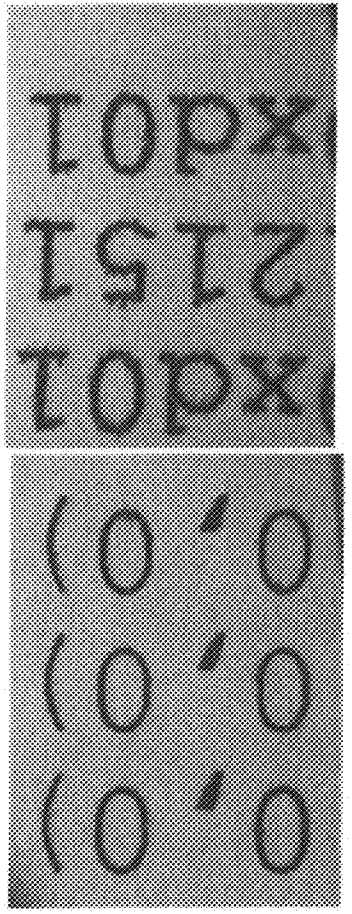

FIG. 1 is a schematic presentation of the behaviour of a block copolymer on the surface of paper;

FIG. 2 describes the four possible structural variations of an amphiphilic polymer;

FIG. 3 describes a synthesis of typical amphiphilic structures generated by way of a condensation reaction;

FIGS. 4*a* and *b* show SEM photographs of fine paper coated with a block copolymer (FIG. 4*a*) and, correspondingly, of uncoated fine paper (FIG. 4*b*);

FIGS. 5*a* and *b* show how an aqueous ink penetrates into a paper that is covered with an amphiphilic polymer (FIG. 5*a*) and, correspondingly, into an uncoated paper (FIG. 5*b*);

FIG. 6 is a bar chart, which shows how an amphiphilic block copolymer affects the surface energy of fine paper;

FIGS. 7*a* and 7*b* show microscope pictures of how ink is absorbed into paper which is uncoated and, correspondingly, paper treated according to the present invention.

The amphiphilic polymers are copolymers, the structure of which can be linear block copolymers, graft copolymers or star copolymers. The typical structural variations are shown in FIG. 2. The amphiphility is a result of the different polarity of the blocks of the polymers. In a more limited sense, one of the blocks of the amphiphilic copolymer is hydrophilic, water-soluble, and the other hydrophobic, water-insoluble. In the present invention, the focus has been on linear block copolymers, which can have two or more blocks.

The production and the properties of amphiphilic polymers are described in, among others, the following publications: U.S. Pat. Nos. 6,887,962, 6,538,091 and 6,624,262; Vlcek et al., Polymer 46 (2005), pp. 4991-5000; Sugiyama et al., Polymer 44 (2003), pp. 4157-4164; Dworak et al., Reactive and Functional Polymers 42 (1999), pp. 31-36; Chognot et al., Journal of Colloid and Interface Science 268 (2003), pp. 441-447 and Kurian et al., Journal of Polymer Science: Part A: Polymer Chemistry 38 (2000), pp. 3200-3209.

The simplest way of producing linear amphiphilic block structures is by way of a condensation reaction of macromonomers. The method is described in FIG. 3.

With the present method it is possible to produce controlled structures only if one of the macromonomers has just a single functional group which reacts with the other polymer. In this case, it is possible to produce two-block and three-block structures. If there are more functional groups, the result is a variable multi-block structure and often a polymer which has a broad molar mass distribution.

Until very recent times, commercial production of block copolymers which comprise vinyl monomers has been expensive, difficult and limited to a rather small group of monomers. Traditionally, such block copolymers have been produced using a living anionic and cationic polymerisation mechanism by adding the monomers one after another into the reaction mixture. The weakness of the method results from the very low reaction temperatures, and because the growing anionic chain is sensitive to polar groups.

A new method, the so called living radical polymerisation, has been developed for the production of block copolymers of vinyl monomers. This living radical polymerisation method allows the reactions to be carried out at room temperature; moreover, this method is not as sensitive to polar groups as traditional living polymerisation methods.

Preferably, an amphiphilic block copolymer material, which is brought onto the surface of the substrate in the form of an aqueous solution, emulsion, colloidal mixture or dispersion, is used in the present invention, especially, the polymer is dissolved or dispersed in water. The structure of the block copolymer can be a two-block or three-block copolymer. As mentioned above, typically, an amphiphilic block copolymer comprises both a water-soluble (hydrophilic) and a water-insoluble (hydrophobic) block. The molar ratio between the hydrophilic and, correspondingly, the hydrophobic blocks is generally approximately 25:1 to 1:2, especially approximately 20:1 to 1:1. The molar ratio varies depending on whether a block copolymer, which is water-soluble, micellic or dispersed in water, is preferred, in which case a better water-solubility is obtained with a high hydrophil/hydrophobe ratio (for instance above 5 or above 7), than with a low (for instance below 3). Typically, the ratio is approximately 12:1 to 5:1.

The hydrophilic block of an amphiphilic polymer can be any water-soluble polymer, to which it is possible to attach a hydrophobic block through a reaction. Examples of hydrophilic blocks are water-soluble polysaccharides, such as CMC and similar ether derivatives of cellulose, polyethylene oxide, polyvinyl pyrrolidone, polyhydroxy ethylmethacrylate, polyvinyl alcohol, polyacrylamide, polydimethylaminoethylmethacrylate, polyacrylic acid and polymethacrylic acid and their cationic (quaternated) forms, especially derivatives of polysaccharides and cellulose, and cationic forms of acrylic acid polymers, copolymers formed of the monomer units comprised in these, or mixtures of polymers of these or similar hydrophilic blocks.

Examples of monomers which form hydrophobic blocks are n-octadecenyl succinic acid and succinic acid anhydride and similar alkyl-substituted acids and their anhydrides, styrene, methylmethacrylate, butylmethacrylate, and hydrophobic derivatives of acrylic acid and other similar unsatisfied acids, vinyl acetate and fluoridated derivatives of these, and mixtures and polymers of these. Generally, the derivatives of acrylic acid correspond to the formula $H_2C—CR^1—COOR^2$, where $R^1$ is a $C_{1-6}$ alkyl and $R^2$ is an alkyl, especially a $C_{1-6}$ alkyl, or an aryle group. An example of a fluoridated monomer is, in turn, fluoridated styrene, which is used in the test shown in FIG. 7*b*. A hydrophobic block can be a polyolefin, too, or a mixture/copolymer of an olefin and one or several of the above mentioned monomers.

The molar mass of the amphiphilic polymers used in the present invention can vary within a wide range, depending on what kinds of hydrophilic and, correspondingly, hydrophobic blocks the copolymer comprises. However, generally the molar mass is approximately 500-500,000 g/mole, especially approximately 1,000-350,000 g/mole and most suitably approximately 2,000-250,000 g/mole. Generally, polymers with a molar mass of for instance 3,000-50,000 g/mole, are used.

Often it is desirable to produce linear block structures, in which case polyethylene oxide (PEO) is used as the hydrophilic block. The only reactive groups in PEO are the hydroxyl groups which are situated at the end of the chain, and therefore it is easy to produce linear block copolymers of the PEO. Other hydrophiles which are used in the amphiphiles are, among others, the above mentioned poly(4-vinyl-pyrrolidone), polymethacrylic acid and polyacrylic acid, but to make these polymers reactive they must be modified with the help of chain changing agents, or the block structure must be produced through the living radical mechanism.

According to a preferred embodiment, for instance polyethylene oxide acts as the water-soluble block and octadecenyl succinic acid as the water-insoluble block. In a block copolymer such as this, the ratio between the hydrophilic blocks and the hydrophobic blocks can be the same as above. Most suitably it is 15:1 to 2:1. When the percentage of the hydrophilic blocks is more than 85 molar %, the polymer is at least essentially water-soluble and it is possible to apply it in the aqueous phase without using solvents. The average weight of the molar mass of these polymers can be of the same magnitude as above, typically, however, approximately 1,000-250,000 g/mole, especially approximately 3,000-30,000 g/mole.

When amphiphilic block copolymers according to the present invention are used, it is not necessary to seal the surface of the paper, as in traditional coating technique, but the polymers are evenly spread onto the surface of the fibres, in which case they at least partly prevent the printing inks from penetrating into the paper. On the surface of the paper the polymers are able to form a uniform or partly uniform layer.

The amphiphilic polymer is applied onto the surface by using roll coating, curtain coating or spray coating or some other similar method, and typically in the form of an aqueous emulsion, aqueous dispersion or aqueous solution, as mentioned above.

An example of the covering power of the polymer layer, which is formed of amphiphilic polymers, is shown in the SEM photographs in FIGS. 4*a* and 4*b*. It can be stated that the amount of polymer on the surface of the paper is very small and it does not seal the paper surface. Typical quantities of the amphiphilic polymer used are less than 1 $g/m^2$, but usually approximately 0.001-10 $g/m^2$, preferably approximately 0.005-5 $g/m^2$, especially approximately 0.01-3 $g/m^2$, of the amphiphilic block copolymer is applied onto the surface of the substrate.

The amphiphilic polymer which is applied onto surface of the substrate forms either a homogeneous, thin layer, which is generally at maximum approximately 500 nm thick, or individual drops or spots, which are at least partly separated from each other. The thin, approximately 10-500 nm layer comprises a depth of typically only one molecule ("monomolecular layer"). It is possible to achieve this by using a water-soluble polymer. The polymer, in turn, which is brought onto the surface in the form of a dispersion or an emulsion remains on the surface in the form of discrete dots or drops or spots, but when used in conjunction with calendering or a similar treatment, it is possible to spread and smooth out at least part of these spots so that they form a homogeneous layer.

A paper or cardboard which is treated according to the present invention is most suitable as a printing bed. This is demonstrated in the example in FIG. 5: when water-soluble ink was applied onto both a coated and an uncoated area, much less of the ink was absorbed in the area that was coated, whereby the ink did not spread out any wider. However, the absorption is sufficient to ensure that the ink remains in the surface.

On the basis of the contact angles of different test fluids, the polar and the dispersive component of the surface energy and the total surface energy of fine paper, which is either coated or uncoated with amphiphilic block copolymer, were calculated. The results are graphically shown in FIG. 6. It was found that by using amphiphilic polymer it is possible to lower effectively the total surface energy of the paper.

The layer, which is formed on the surface of the paper or cardboard and which is typically 10-500 nm thick, decreases the capillary ability of the substrate to absorb liquids, in which case it is possible to substantially reduce for instance the penetration of the printing inks through the paper and the spreading of the printing ink. Compared with a corresponding, untreated substrate, the print-through properties and the sharpness of the imprint are generally improved by at least 20%.

FIGS. 7*a* and 7*b* show how the ink is absorbed into the surface of the paper. FIG. 7*a* shows the result of an ink test in which the colour ink from the tip of a felt-tip pen was absorbed into fine paper, and FIG. 7*b* shows an imprint produced by ink-jet printing. In both cases, the left picture shows an uncoated fine paper, and the right picture shows a paper which is treated according to the present invention.

In the example according to FIG. 7*a*, a coating containing fluoridated styrene/polyethylene oxide-block polymer was sprayed, using a 3% aqueous solution, onto the surface of the paper so that the quantity of the polymer in the coating was approximately 0.5 $g/m^2$.

The microscopic picture with the same enlargement shows that the capillary penetration of the colorant fluid is essentially lower in the case of nanocoating.

Correspondingly, in the case of FIG. 7*b*, fine paper was coated with octylsuccinicanhydride/-polyethylene oxide-block polymer (0.8 $g/m^2$), in which case the picture clearly shows that the capillary penetration of the colorant is lower and the imprint is sharper.

It is possible to modify any fibrous substrate, when using a method according to the present invention. Especially, the fibrous material is paper, cardboard, cellulose sheet, paper or cardboard or pulp made from recycled fibre, or fabric, or natural fibre pulp, or sheet or fabric made from synthetic fibres, such as fibre fabric, or a three-dimensional piece made from the above materials. In addition, the fibrous material can comprise other components, such as fillers.

Examples of the fillers are mineral fillers, such as calcium carbonate and kaolin. More preferably, the present invention is suitable for treatment of paper and cardboard webs and paper and cardboard sheets, but it is also possible to modify for instance wood fibres which are used in insulating materials.

Regarding paper and cardboard, the substrate is typically either a wood-containing or wood-free web, i.e. a so called base paper or base cardboard, the fibres of which are cellulose-based or lignocellulose-based. The fibres of the product can be virgin fibres or recirculated fibres. More preferably, the base web is untreated, but it is also possible to modify a surface-sized web or sheet. After the treatment, a surface is generated, the properties of which are principally hydrophobic, because the amphiphilic polymer is, via the hydrophilic blocks, mainly bound to the cellulose or the lignocellulose fibres of the web or the sheet, in which case the hydrophobic blocks remain free, as shown in FIG. 1.

A paper or cardboard web which has been prepared as described above, can be further treated by surface-sizing, coating or calendering it, depending on the application. However, a treatment according to the present invention makes it possible to modify the web and not use any other treatment, except, possibly, calendering. The reason is that in those cases when the amphiphilic polymer forms star-shaped structures on the surface of the substrate (see FIG. 1*a*), for instance when the polymer, in a dispersion form, has been brought into contact with the substrate, it is possible to conveniently prepare the surface by calendering, in which case the star-shaped structures are flattened and leave the hydrophobic tail free on the surface of the substrate.

It is possible to carry out the calendering as on-line calendering or as offline calendering, for instance by using an online-soft-calender or an offline-supercalender.

The grammage of the paper or cardboard to be treated can vary freely, however, typically it is approximately 50-500 g/m$^2$. Generally, the grammage of the base paper is 30-300 g/m$^2$, preferably 30-80 g/m$^2$ for papers, and 90-400 g/m$^2$ for cardboards.

After a treatment according to the present invention, the papers and cardboards are suitable to be used as printing beds. Especially, they can be used as graphic papers, fine papers and papers suitable for ink-jet printing.

The following non-restrictive examples of application illustrate the present invention. It should be pointed out that the molar masses of the PEO-OSA copolymers, which are prepared in the examples described below, were generally approximately 3,000-10,000 g/mole. In the production of the polymers, a surplus of the hydrophobic component was used; the surplus was 1.5- to 100-fold, typically approximately 5- to 50-fold, the amount of the hydrophilic component. As mentioned above, the percentage of the hydrophilic blocks in the final copolymer is generally higher than the percentage of the hydrophobic blocks.

EXAMPLE 1

Production of a PEO-b-OSA Copolymer

Polyethylene oxide (20 g; 2 mmol) and n-octadecenyl succinic acid anhydride (5.3 g; 15.1 mmol) are put into a laboratory bottle, into which a flow of nitrogen is led. The mixture is heated at 130° C. for 6 h. The resulting mixture is dissolved in water and extracted four times using the same volume of dichlormethane. The dichlormethane phase is recovered and the dissolvent is removed by using low pressure in a rotavapor. The polymer produced is separated out by redissolving the dry residue in dichlormethane and precipitating it with diethyl ether. The product is separated from the solution by filtering. Finally, the product is dried in a vacuum at room temperature for 8 h.

EXAMPLE 2

Production of a PEO-b-OSA Copolymer

Polyethylene oxide (20 g; 3.33 mmol) and n-octadecenyl succinic acid anhydride (3.5 g; 9.98 mmol) are put into a laboratory bottle, into which a flow of nitrogen is led. The mixture is heated at 130° C. for 6 h. The resulting mixture is dissolved in water and extracted four times using the same volume of dichlormethane. The dichlormethane phase is recovered and the dissolvent is removed by using low pressure in a rotavapor. The polymer produced is separated out by redissolving the dry residue in dichlormethane and precipitating it with diethyl ether. The product is separated from the solution by filtering. Finally, the product is dried in a vacuum at room temperature for 8 h.

EXAMPLE 3

Production of a PEO-b-OSA Copolymer

Polyethylene oxide (20 g; 5 mmol) and n-octadecenyl succinic acid anhydride (7.9 g; 22.54 mmol) are put into a laboratory bottle, into which a flow of nitrogen is led. The mixture is heated at 130° C. for 6 h. The mixture produced is dissolved in water and extracted four times using the same volume of dichlormethane. After that, the dichlormethane phase is recovered and the dissolvent is removed by means of low pressure in a rotavapor. The polymer produced is separated out by redissolving the dry residue in dichlormethane and precipitating it with diethyl ether. The product is separated from the solution by filtering. Finally, the product is dried in a vacuum at room temperature for 8 h.

EXAMPLE 4

Production of a PEO-b-OSA Copolymer

Polyethylene oxide (20 g; 10 mmol) and n-octadecenyl succinic acid anhydride (15.7 g; 44.79 mmol) are put into a laboratory bottle, into which a flow of nitrogen is led. The mixture is heated at 130° C. for 6 h. The mixture produced is dissolved in water and extracted four times using the same volume of dichlormethane. After that, the dichlormethane phase is recovered and the dissolvent is removed by means of low pressure in a rotavapor. The polymer produced is separated out by redissolving the dry residue in dichlormethane and precipitating it with diethyl ether. The product is separated from the solution by filtering. Finally, the product is dried in a vacuum at room temperature for 8 h.

EXAMPLE 5

Production of a Monofunctional PEO Macroinitiator

Solutions are made of monomethyl ether of polyethylene oxide (20 g; 4 mmol) and propynyl chloride (1.1 g; 12 mmol) in dichlor-methane. The reaction vessel is placed in a bath of ice and a flow of nitrogen is led into it. The polyethylene oxide solution is added into the reaction vessel and the propynyl chloride is added in drops into the reaction vessel for a period of 1 h. After that, the reaction vessel is placed in conditions of room temperature and the temperature of the reaction mixture is allowed to even out over a period 18 h. Finally, triethylamine, which is dissolved in dichloride methane, is added in drops into the reaction mixture until the mixture becomes alkaline. The solution is filtrated, half of the dissolvent is removed in a vacuum and the macroinitiator is precipitated with cold diethyl ether. The macroinitiator is then recovered by filtration and dried over night in a vacuum.

EXAMPLE 6

Production of a Difunctional PEO Macroinitiator

Solutions are made of polyethylene oxide (20 g; 2 mmol) and propynyl chloride (1.1 g; 12 mmol) in dichlor-methane. The reaction vessel is placed in a bath of ice and a flow of nitrogen is led into it. The polyethylene oxide solution is added into the reaction vessel and the propynyl chloride is added in drops into the reaction vessel for a period of 1 h. After that, the reaction vessel is placed in conditions of room temperature and the temperature of the reaction mixture is allowed to even out over a period 18 h. Finally, triethylamine, which is dissolved in dichloride methane, is added in drops into the reaction mixture until the mixture becomes alkaline. The solution is filtrated, half of the dissolvent is removed in vacuum and the macroinitiator is precipitated with cold diethyl ether. The macroinitiator is then recovered by filtration and dried over night in vacuum.

EXAMPLE 7

Production of a PEO-b-PS Copolymer

The monofunctional PEO macroinitiator according to example 5 (6 g; 1.2 mmol) together with a catalyst (0.68 g; 1.2 mmol) (with a molar ratio of 1:3, CuCl and 2,2'-bipyridine) are added into a laboratory bottle and the bottle is sealed with a rubber bung. The oxygen is extracted from the bottle by applying a vacuum. A styrene monomer (0.7 g; 6.4 mmol), from which the gas has been removed, is added into the laboratory bottle by means of an injection syringe which has been cleaned with nitrogen gas. A vacuum is applied in the bottle and it is refilled three times with nitrogen gas. The mixture in the bottle is mixed for 5 minutes. The bottle is placed into a bath of oil, which has been preheated to 140° C. When the reaction has been allowed to advance for a period of 16 h, it is stopped by cooling the reaction mixture to room temperature. The mixture produced is dissolved in dichlor-methane. The catalyst is removed from the solution by driving the solution through a layer of aluminium oxide. The polymer is then precipitated with hexane. The precipitated polymer is washed in cold diethyl ether, after which it is dried in vacuum at room temperature. The unreacted styrene and the homopolymer of polystyrene that may have been generated are removed by extracting the polymer with cyclo-hexane for 72 hours. The solvent used for the extraction is changed every 24 hours. After the extraction, the product is dried in a vacuum at room temperature. Finally, the unreacted PEO macroinitiator is removed by rinsing the polymer twice with distilled water at room temperature.

EXAMPLE 8

Production of a PS-b-PEO-b-PS Copolymer

The difunctional PEO macroinitiator according to example 6 (6 g; 0.6 mmol) together with a catalyst (0.68 g; 1.2 mmol) (with a molar ratio of 1:3, CuCl and 2,2'-bipyridine) are added into a laboratory bottle and the bottle is sealed with a rubber bung. The oxygen is extracted from the bottle by applying a vacuum. A styrene monomer (0.7 g; 6.4 mmol), from which the gas has been removed, is added into the laboratory bottle by means of an injection syringe which has been cleaned with nitrogen gas. A vacuum is applied in the bottle and it is refilled three times with nitrogen gas. The mixture in the bottle is mixed for 5 minutes. The bottle is placed into a bath of oil, which has been preheated to 140° C. When the reaction has been allowed to advance for a period of 16 h, it is stopped by cooling the reaction mixture to room temperature. The mixture produced is dissolved in dichlor-methane. The catalyst is removed from the solution by driving the solution through a layer of aluminium oxide. The polymer is then precipitated with hexane. The precipitated polymer is washed in cold diethyl ether, after which it is dried in vacuum at room temperature. The unreacted styrene and the homopolymer of polystyrene that may have been generated are removed by extracting the polymer with cyclo-hexane for 72 hours. The solvent used for the extraction is changed every 24 hours. After the extraction, the product is dried in a vacuum at room temperature. Finally, the unreacted PEO macroinitiator is removed by rinsing the polymer twice with distilled water at room temperature.

EXAMPLE 9

Production of a FPS-b-PEO Copolymer

The difunctional PEO macroinitiator according to example 5 (6 g; 0.6 mmol) together with a catalyst (0.68 g; 1.2 mmol) (with a molar ratio of 1:3, CuCl and 2,2'-bipyridine) are added into a laboratory bottle and the bottle is sealed with a rubber bung. The oxygen is extracted from the bottle by applying a vacuum. Pentafluoro styrene (0.7 g; 3.4 mmol), from which the gas has been removed, is added into the laboratory bottle by means of an injection syringe which has been cleaned with nitrogen gas. A vacuum is applied in the bottle and it is refilled three times with nitrogen gas. The mixture in the bottle is mixed for 5 minutes. The bottle is placed into a bath of oil, which has been preheated to 140° C. When the reaction has been allowed to advance for a period of 16 h, it is stopped by cooling the reaction mixture to room temperature. The mixture produced is dissolved in dichlor-methane. The catalyst is removed from the solution by driving the solution through a layer of aluminium oxide. The polymer is then precipitated with hexane. The precipitated polymer is washed in cold diethyl ether, after which it is dried in vacuum at room temperature. The unreacted pentafluoro styrene and the homopolymer of pentafluoro styrene that may have been generated are removed by extracting the polymer with cyclo-hexane for 72 hours. The solvent used for the extraction is changed every 24 hours. After the extraction, the product is dried in a vacuum at room temperature. Finally, the unreacted PEO macroinitiator is removed by rinsing the polymer twice with distilled water at room temperature.

EXAMPLE 10

Production of a FPS-b-PEO-b-FPS Copolymer

The difunctional PEO macroinitiator according to example 6 (6 g; 0.6 mmol) together with a catalyst (0.68 g; 1.2 mmol) (with a molar ratio of 1:3, CuCl and 2,2'-bipyridine) are added into a laboratory bottle and the bottle is sealed with a rubber bung. The oxygen is extracted from the bottle by applying a vacuum. Pentafluoro styrene (0.7 g; 3.4 mmol), from which the gas has been removed, is added into the laboratory bottle by means of an injection syringe which has been cleaned with nitrogen gas. A vacuum is applied in the bottle and it is refilled three times with nitrogen gas. The mixture in the bottle is mixed for 5 minutes. The bottle is placed into a bath of oil, which has been preheated to 140° C. When the reaction has been allowed to advance for a period of 16 h, it is stopped by cooling the reaction mixture to room temperature. The mixture produced is dissolved in dichlor-methane. The catalyst is removed from the solution by driving the solution through a layer of aluminium oxide. The polymer is precipitated with hexane. The precipitated polymer is washed in cold diethyl ether, after which it is dried in vacuum at room temperature. The unreacted pentafluoro styrene and the homopolymer of pentafluoro styrene that may have been generated are removed by extracting the polymer with cyclo-hexane for 72 hours. The solvent used for the extraction is changed every 24 hours. After the extraction, the product is dried in a vacuum at room temperature. Finally, the unreacted PEO macroinitiator is removed by rinsing the polymer twice with distilled water at room temperature.

EXAMPLE 11

Coating of Paper Using an Amphiphilic Block Copolymer

A 1 . . . 5 m-% aqueous solution, emulsion, colloidal mixture or dispersion is prepared of dry amphiphilic block copolymer. The sheet to be coated is weighed before the coating and 8 h after the coating. The aqueous solution is sprayed by using compressed air onto the surface of the paper. The weight of the coating is adjusted with the help of the volume of the solution. The damp sheet is moved into an oven, where it is dried at 120° C. for 5 min. The weight of the coating of the sheet is determined with the help of the weights of the uncoated and the coated sheet, and the area which has been coated.

EXAMPLE 12

The Effect of an Amphiphilic Block Copolymer on the Contact Angles of the Test Fluids The effect of amphiphilic polymers on different test fluids is examined by measuring the contact angles. The test fluids used in the measuring are water, glycerol, tricresyl phosphate, formamide and methyl iodide. Table 1 shows how the amphiphilic block copolymer affects the contact angle of the test fluids on the surface of fine paper, when the paper is coated with block copolymer. It has been found that the polymer increases the contact angle, regardless of the test fluid; the glycerol has the greatest effect.

TABLE 1

The effect of an amphiphilic block copolymer on the contact angle of the test fluids.

| | Water | Glycerol | Tricresyl phosphate | Formamide | Methyl iodide |
|---|---|---|---|---|---|
| PEO6k-OSA | 68 | 84 | 58 | 63 | 43 |
| PEO20k-OSA | 72 | 54 | 27 | 53 | 34 |
| Water-treated fine paper | 48 | 18 | 19 | 25 | 28 |
| Untreated fine paper | 58 | 18 | 17 | 20 | 22 |

EXAMPLE 13

Ink-Jet Printing of an A4 Sheet which is Coated with an Amphiphilic Block Copolymer An A4 sheet is coated with an aqueous solution of 3% amphiphilic block copolymer, using a solution volume of 15 ml. In order to generate a reference area, the upper edge of the sheet is covered with an A6-sized sheet before the coating. Using an ink-jet printer and the "Times New Roman" font and a font size of 12, the following text was printed on the sheet: "Tämä on inkjet-painatuskoe amfifiilisellä lohkokopolymeerillä päällystetylle arkille" ("This is an ink-jet printing test on a sheet coated with an amphiphilic block copolymer"), every third line was used and the spacing was 1.0. By comparing the imprint in the coated area with that in the uncoated area, it can be seen that the spreading of the ink-jet printing ink is less on the paper which has been treated with the amphiphilic block copolymer, whereby the letters are sharper and the lines are thinner.

The invention claimed is:

1. A method of treating the surface of a substrate which comprises a fibrous material for modifying the printability properties of said surface, characterized by contacting the surface with an amphiphilic block copolymer which comprises a hydrophilic block of poly(ethylene oxide) and a hydrophobic block of n-octadecenyl succinic acid, wherein the molar ratio between the hydrophilic block and the hydrophobic block ranges from 25:1 to 1:2, said amphiphilic block copolymer contacting the surface while in the form of an aqueous solution, an emulsion, a colloidal mixture or a dispersion.

2. The method according to claim 1, characterized by applying approximately 0.001-10 g/m$^2$ of an amphiphilic block copolymer onto the surface of the substrate.

3. The method according to claim 1, wherein the amphiphilic polymer has a form which is straight-chained, grafted or starshaped.

4. A method according to claim 1, wherein said treating comprises applying said amphiphilic polymer to form a coating which modifies the fibres of the substrate.

5. A method according to claim 1, characterized by said amphiphilic block copolymer forming a self-organised nanostructure on the surface of the fibres of the substrate.

6. A method according to claim 1, characterized by applying the amphiphilic polymer onto the surface of the substrate by roll coating, curtain coating or spray coating.

7. A method according to claim 1, characterized in that the substrate, which is formed by the fibrous material, comprises a paper or cardboard web.

8. The method according to claim 7, characterized by calendering the paper or cardboard web which has been treated with the amphiphilic polymer.

9. A method according to claim 1, characterized in that the molar ratio between the hydrophilic and, correspondingly, the hydrophobic blocks of the amphiphilic polymer is approximately 20:1 to 1:1.

10. A method according to claim 9, characterized in that the molar ratio between the hydrophilic and, correspondingly, the hydrophobic blocks of the amphiphilic polymer is approximately 15:1 to 2:1.

11. A product produced by a process which comprises contacting the surface of a paper or cardboard web or sheet with an amphiphilic block copolymer which comprises a hydrophilic block of polyethylene oxide) and a hydrophobic block of n-octadecenyl succinic acid, wherein the molar ratio between the hydrophilic block and the hydrophobic block ranges from 25:1 to 1:2, said amphiphilic block copolymer contacting said surface while in the form of an aqueous solution, an emulsion, a colloidal mixture, or a dispersion.

12. The product according to claim 11, characterized in that approximately 0.01-3 $g/m^2$ of an amphiphilic block copolymer have been applied onto the surface of the substrate.

13. A product according to claim 11, characterized in that the amphiphilic block copolymer forms a 10-500 nm thick layer on the surface of the surface of the paper or cardboard web or sheet.

14. A product according to claim 11, characterized in that the amphiphilic block copolymer forms discrete spots on the surface of the surface of the paper or cardboard web or sheet.

* * * * *